US007789224B2

(12) United States Patent
Diamond

(10) Patent No.: US 7,789,224 B2
(45) Date of Patent: Sep. 7, 2010

(54) JEWELRY CHAIN HOLDER

(76) Inventor: Patricia Mary Diamond, 507 Timber Oaks Rd., Edison, NJ (US) 08820

( * ) Notice: Subject to any disclaimer, the term of this patent is extended or adjusted under 35 U.S.C. 154(b) by 966 days.

(21) Appl. No.: 11/580,752

(22) Filed: Oct. 16, 2006

(65) Prior Publication Data

US 2008/0098709 A1 May 1, 2008

(51) Int. Cl.
*A45C 11/04* (2006.01)

(52) U.S. Cl. ..... 206/6.1; 206/566; 206/486

(58) Field of Classification Search ..... 206/6.1, 206/348, 566; 220/539, 552, 553
See application file for complete search history.

(56) References Cited

U.S. PATENT DOCUMENTS 4,396,121 A * 8/1983 Lemmon ..... 206/6.1
5,117,971 A * 6/1992 Fisher ..... 206/6.1
5,168,985 A * 12/1992 Shih ..... 206/6.1
5,833,052 A * 11/1998 Diamond ..... 206/6.1

* cited by examiner

*Primary Examiner*—Mickey Yu
*Assistant Examiner*—Chun Cheung

(57) ABSTRACT

A novel jewelry chain holder is described which is adapted to receive and hold a plurality of jewelry chains of varying lengths such that the chains will not be entangled or twisted in the storage container.

3 Claims, 2 Drawing Sheets

JEWELRY CHAIN HOLDER

FIELD OF THE INVENTION

This invention relates to a novel jewelry chain holder. More specifically, the present invention relates to a jewelry chain holder adapted to receive and hold a plurality of jewelry chains of varying lengths in a manner such that the chains will not become entangled or twisted while stationary.

BACKGROUND OF THE INVENTION

Jewelry chain holders have been described heretofore for holding chains in a manner such that they will not become tangled or knotted. And although some of the structures described heretofore have been successfully employed for this purpose, it has been recognized by those skilled in the art that certain limitations are inherent therein.

DESCRIPTION OF THE PRIOR ART

In as classical example of a jewelry holder meeting the aforementioned criteria, U.S. Pat. No. 5,833,052 issued on Nov. 10, 1998 discloses a jewelry chain holding structure which meets the foregoing criteria. The structure described therein includes a container having a rectangular configuration having disposed therein a jewelry chain holder which precludes jewelry chains from becoming entangled and knotted during the storage stage.

The patented structure described therein comprises a container having an elongated rectangular configuration. The container has an open upper end and an open lower end and opposing side walls. The container also includes a pair of longitudinal grooves formed interiorly on two of the opposing walls. The grooves described begin at the open upper end and extend to a steep point disposed above the open lower end. A jewelry chain holder is then slidably coupled within the container. The patented chain holder insert comprises an inverted U-shaped handle having a short horizontal segment and a pair of elongated vertical segments extending downwardly from opposed open ends of the short horizontal segment. The jewelry chain holder also includes a t-shaped cross bar secured between the vertical segments of the handle. The t-shaped crossbar has engaging teeth formed in an upper surface which are adapted for receiving jewelry chains in a folded orientation.

Although the jewelry chain holder described in the aforementioned description has been found to be of great use for the purposes described therein, it has not proven to be of use in storing jewelry chains of varying lengths ranging from 14 inches to 20 inches.

SUMMARY OF THE INVENTION

In accordance with the present invention, the prior art limitation alluded to above has been effectively obviated by means of a novel jewelry chain holder capable of holding jewelry chains of varying lengths without the need to be concerned about tangling and knotting issues.

In the instant case, there is described a novel jewelry holding chain structure capable of holding a plurality of jewelry chains of lengths varying from 14 inches to 20 inches. The described structure includes a container having an open upper end which may suitably be closed by affixing a rectangular cap thereto after insertion of the chains to be stored, and a closed bottom end.

The inventive concept involves the insertion into the container of a novel jewelry chain holder which is adapted to receive jewelry chains of varying lengths within the range of 14 to 20 inches.

BRIEF DESCRIPTION OF THE DRAWING

The invention will be more fully understood by reference to the following detailed description taken in conjunction with the accompanying drawing wherein.

DETAILED DESCRIPTION OF THE DRAWING

Figure 1:
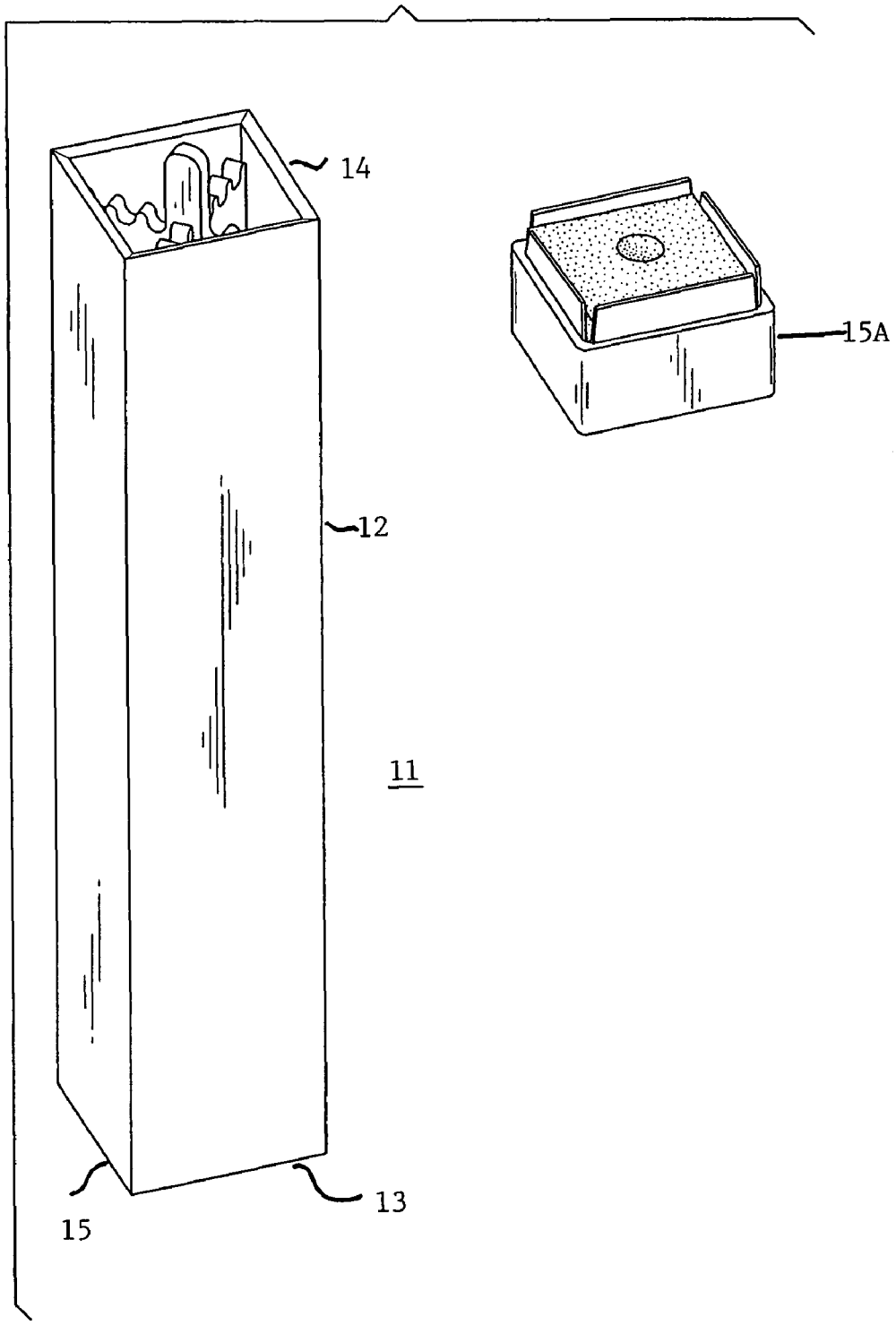
FIG. 1 is a front elevational view in perspective of a jewelry chain holder container in accordance with the present invention.

With reference now to FIG. 1, there is shown a front elevational view in perspective of the jewelry holder container employed in the practice of the present invention.

Jewelry holder 11 includes a container 12 having a rectangular configuration which is closed at the lower end 13 and open at the upper end 14. The preferred construction of container 12 is a rigid plastic material such as Lucite. As indicated, container has an open upper end 14 and opposing side walls 15 and cap 15A.

Figure 2:
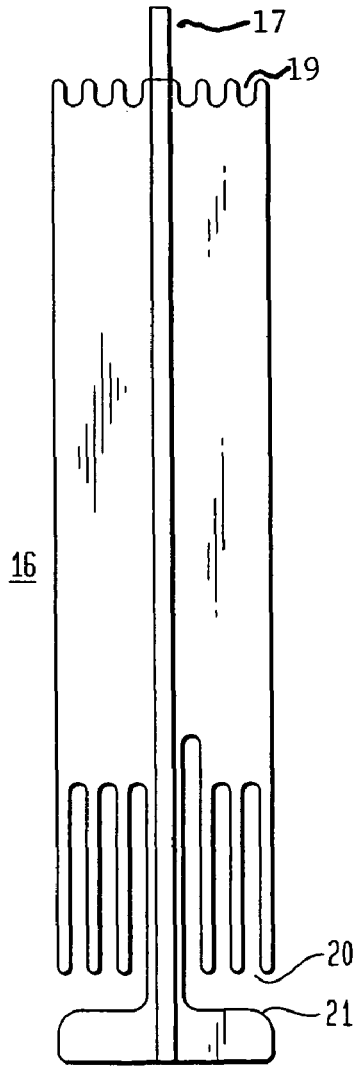
FIG. 2 is a front elevational view of the jewelry holder insert in accordance with the present invention.

Shown in FIG. 2 is a jewelry chain holder of the present invention 16 dimensioned for coupling within container 12. Holder 16 includes a flat inverted U-shaped handle 17 comprising an integral part of the jewelry holder 16 which has four plastic holders 18, each having a U-shaped top surface 19 and an inverted U-shaped bottom surface 20 wherein the depth of the U-shape is permitted to vary to accommodate chains ranging from 14 to 20 inches in length. Also shown is t-shaped base 21 which rests at the bottom of jewelry holder 16 at the lower end thereof.

In use, the engaging teeth receive the jewelry chains in folded orientation at the upper surface and the bottom surface of the chain is inserted in the inverted U-shaped engaging teeth of the lower portion of the holder, the inverted U-shaped engaging teeth being selected to accommodate chains ranging from 14 to 18 inches in length.

After storing chains of varying lengths in holder 17, the holder is inserted into container 12 until the base reaches the bottom thereof. Then cap 15A is inserted on the open end of container 12 and the structure is then ready for storage.

Figure 3:
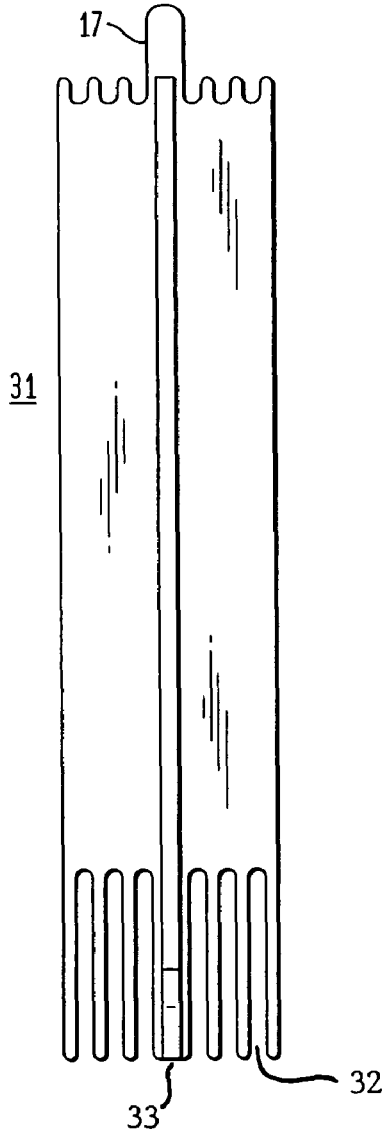
FIG. 3 is a front elevational view of a second jewelry holder insert in accordance with the present invention.

FIG. 3 is a front elevational view of another jewelry holder 31 of the type shown in FIG. 2 with the exception that holder 31 is structured such that it is capable of accommodating jewelry chains ranging in length from 18 to 20 inches. The primary distinction in this structure is the variation in the dimensions of the inverted U-shaped structures 32 at the bottom end thereof wherein the base member 33 is of equal length with the inverted U-shaped members 32 which are designed such that they are capable of accommodating longer chains.

While the invention has been described in detail in the foregoing description, it will be appreciated by those skilled in the art that variations may be made without departing from the spirit and scope of the invention. Thus, for example, the dimensions of the inverted U-shaped structures at the base of the holder may be modified to accommodate chains of even greater length than those alluded to herein. Similarly, variations may be made in the construction of the jewelry holder without departing from the invention.

What is claimed is:

1. A jewelry chain holder for holding jewelry chains without entanglement during storage of said chains comprising:

a container having an elongated and rectangular configuration, an open upper end, a closed bottom end, and transparent, opposing side walls;

a jewelry chain holder removably inserted in the container comprising a first planar, elongated, solid holder having a plurality of teeth at the upper end thereof, each having an U-shaped outline; a plurality of inverted teeth at the lower end thereof, each having an U-shaped outline and of varying dimensions; and an inverted T-shaped leg extending below the lower end; and a second planar, elongated, solid holder having a plurality of teeth at the upper end thereof, each having an U-shaped outline; a plurality of inverted teeth at the lower end thereof, each having an U-shaped outline and of identical dimensions; and a co-planar handle having an inverted U-shaped outline extending from said upper end; and said first holder including said inverted T-shaped leg being of equal length with said second holder, said first and second holders being connected along their longitudinal centerlines and perpendicular to each other.

2. A jewelry chain holder in accordance with claim 1, wherein the open upper end is adapted with a cap for storage.

3. A jewelry chain holder in accordance with claim 2, wherein the inverted teeth are adapted to receive jewelry chains ranging from 14 to 20 inches.

* * * * *